US007252285B2

(12) United States Patent
Albat et al.

(10) Patent No.: US 7,252,285 B2
(45) Date of Patent: Aug. 7, 2007

(54) METHOD AND APPARATUS FOR ALIGNING A MEDIA SHEET

(75) Inventors: Andreas Michael Albat, Delta (CA); Dannye Robert Williams, Burnaby (CA); Andrew Mitchell, North Vancouver (CA); Gil Rosenfeld, North Vancouver (CA)

(73) Assignee: Kodak Graphic Communications Canada Company, Burnaby, British Columbia (CA)

( * ) Notice: Subject to any disclaimer, the term of this patent is extended or adjusted under 35 U.S.C. 154(b) by 168 days.

(21) Appl. No.: 10/662,313

(22) Filed: Sep. 16, 2003

(65) Prior Publication Data

US 2005/0067769 A1 Mar. 31, 2005

(51) Int. Cl.
*B65H 9/04* (2006.01)

(52) U.S. Cl. ..... 271/253; 271/233

(58) Field of Classification Search ..... 271/241, 271/162, 171, 253, 233; 347/104; 400/624, 400/630

See application file for complete search history.

(56) References Cited

U.S. PATENT DOCUMENTS 1,865,879 A * 7/1932 Newhouse ..... 198/698
2,285,076 A * 6/1942 Backhouse ..... 271/231
2,685,446 A * 8/1954 Backhouse ..... 271/253
3,104,873 A * 9/1963 Benson et al. ..... 271/171
3,650,526 A * 3/1972 Schultz ..... 271/265.01
3,897,053 A * 7/1975 Guy ..... 271/238
4,511,904 A * 4/1985 Takahashi ..... 346/134
5,669,724 A * 9/1997 Kato ..... 400/605
5,940,106 A * 8/1999 Walker ..... 347/104
6,123,331 A * 9/2000 Vackier et al. ..... 271/233
6,299,160 B1 10/2001 Tobin et al.
6,314,885 B1 11/2001 Tobin et al.
6,328,394 B1 * 12/2001 Shirai et al. ..... 347/2
6,350,073 B1 * 2/2002 McCue et al. ..... 400/582

FOREIGN PATENT DOCUMENTS

JP 59-203017 * 11/1984
JP 63-117831 * 5/1988

* cited by examiner

*Primary Examiner*—Gene Crawford
*Assistant Examiner*—Thomas Morrison
(74) *Attorney, Agent, or Firm*—Donna P. Suchy

(57) ABSTRACT

An alignment device for aligning a manually loaded media sheet to a printer feed path has at least one registration feature disposed to register the trailing edge of the media sheet to the feed path. By aligning the trailing edge, an orthogonal media sheet is loaded into the printer without skew ensuring that the printed image is precisely aligned to the media sheet.

3 Claims, 5 Drawing Sheets

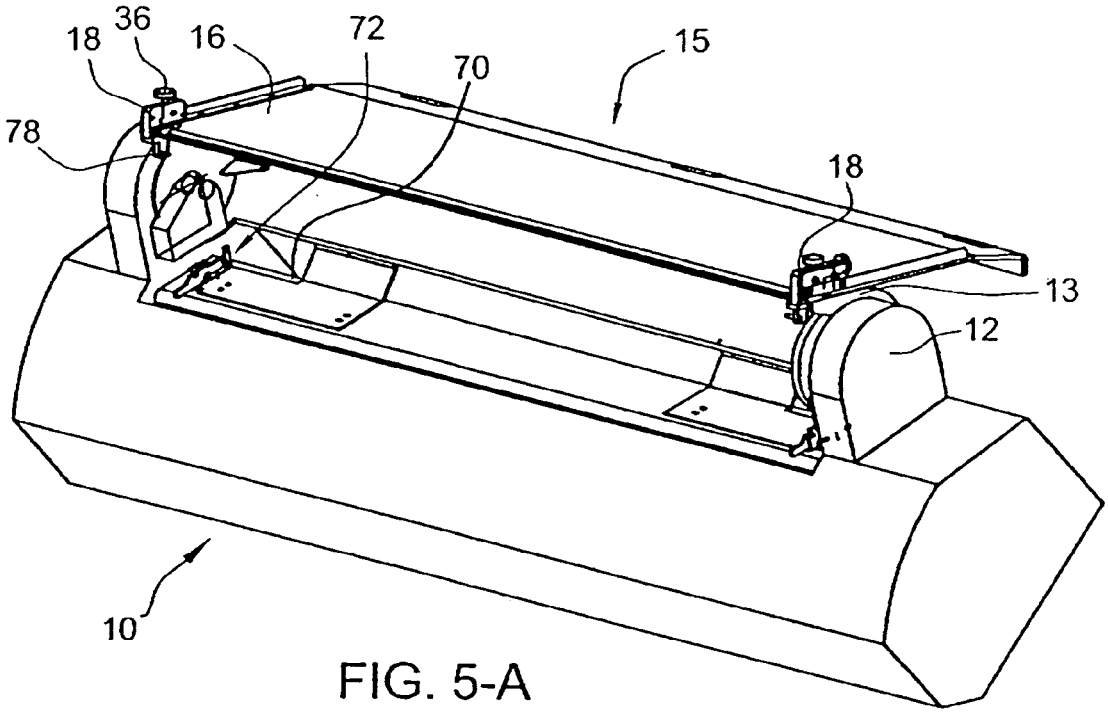
FIG. 5-A
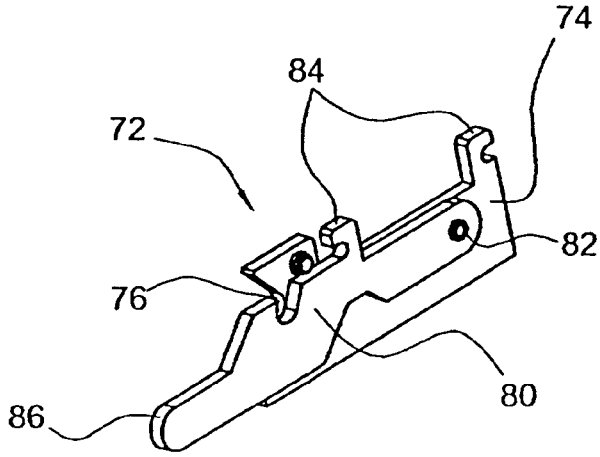
FIG. 5-B

METHOD AND APPARATUS FOR ALIGNING A MEDIA SHEET

TECHNICAL FIELD

The invention relates to the field of printing and more particularly to the registration of a printed image to a media sheet.

BACKGROUND

In high volume printing of multi-page publications such as books, magazines and brochures it is common to print multiple pages on a large sheet known as a signature. The signature is printed both sides in a printing press, then folded, and cut to form a section of the publication. Most publications are made up of many sections, especially those with a large number of pages.

Making a plan for positioning the individual pages on a sheet is known as imposition. Imposition must take many factors into account to ensure that when the publication is bound the pages will be in alignment and correctly sequenced. To reduce the possibility of an imposition error in the final printed press sheet it is common to make an imposition proof prior to running the signature on press. The imposition proof should be an accurate facsimile of the press sheet signature and in particular the correct alignment of individual pages is critical to produce a useful proof sheet.

Due to the high cost of press time it is not practical to run the imposition proof on the printing press. This has lead to the proliferation of stand alone proofers that are specifically designed to make a proof sheets. In recent years there has been considerable interest in using inkjet printers for this purpose. Wide format inkjet printers represent a cost effective alternative to other more costly proofing methods that have been employed in the past. Additionally, inkjet printers equipped with higher imaging quality may also produce images of sufficient quality to serve as a color proofs. One such proofing solution is the Creo Integris™ system that combines a proof controller, an EPSON Stylus ™ Pro 7600 or 9600 or other suitable wide-format inkjet printer and specially qualified inks and media for producing imposition and color proofs.

One problem that presents in adapting commercially available printers to print imposition proofs is maintaining accurate alignment of images to the media sheet. There is a particular problem in double sided printing where it is necessary to align images on the front and back of the printed sheet to within±1 mm or better. Automated solutions such as Spinjet™ made by TechSage of Denmark automatically flip the sheet for reverse side printing while simultaneously taking care of alignment. Unfortunately such add-on hardware is often even more expensive than the printer itself. On the other hand manual flipping of the sheet is very prone to operator error and most moderately priced printers are not equipped to take account of a skewed media sheet.

With a wide proliferation of high quality and low cost wide format printers there is a need for better methods and apparatus for aligning media sheets used in the preparation of proofs. There is a particular need for an in-expensive add-on to such printers that allows accurate manual registration of media sheets.

SUMMARY OF THE INVENTION

The invention provides a method and apparatus for aligning a media sheet to a printer feed path by registering the trailing edge of the media sheet to a registration feature that has been previously aligned to the printer feed path.

In a first aspect of the present invention an alignment device for aligning a media sheet with a print axis of a printer is provided. The he media sheet has a leading edge and a trailing edge. The device comprises at least one registration feature for aligning the trailing edge of the media sheet. The registration feature is located in alignment with the print axis of the printer.

In another aspect of the present invention a method of aligning a media sheet to be loaded into a printer along a feed path is provided. The sheet has a leading edge and a trailing edge. The method comprises loading the media sheet so that the leading edge Df the sheet is in proximity to the feed path and aligning the trailing edge of the media sheet to at least one registration feature.

For an understanding of the invention, reference will now be made by way of example to a following detailed description in conjunction by accompanying drawings.

BRIEF DESCRIPTION OF THE DRAWINGS

In drawings which illustrate by way of example only preferred embodiments of the invention:

FIG. 5-A is a perspective view of an alternate embodiment of the invention; and FIG. 5-B is an enlarged view of the alternate embodiment of the invention shown in FIG. 5-A.

FIG. 6-C shows appartus comprising a proximity sensor.

DESCRIPTION

Wide format inkjet printers typically comprise some means of feeding a media sheet past a printing area. The printing area is traversed by the inkjet heads line-by-line, forming an image on the media sheet while advancing the media through the printer. The printing area may be a platen and may employ vacuum to draw the media down into close contact with the platen. While roll feed media is convenient for single sided printing, when the sheet is flipped andfed into the printer for double sided printing the curl in the mediasheet is often a problem for the media handling components. Double sided proofing is thus more commonly performed with sheet fed media stock. The printer typically includes optical sensors for detecting the edges of the media in order to position the image on the page with respect to the print axis. The sensors will typically detect the location of the leading edge and the sides of the sheet and may even detect skew of the leading edge, if it exists. If the leading edge is skewed to the print axis by more than some specified maximum the sheet is rejected. The term "print axis" is used herein to refer to the axis to which media need be aligned to ensure that the image is printed orthogonal to the media. The print axis may be aligned with the traversing direction of the inkjet printhead but this is not mandated and the print axis may be any other convenient reference.

Figure 1:
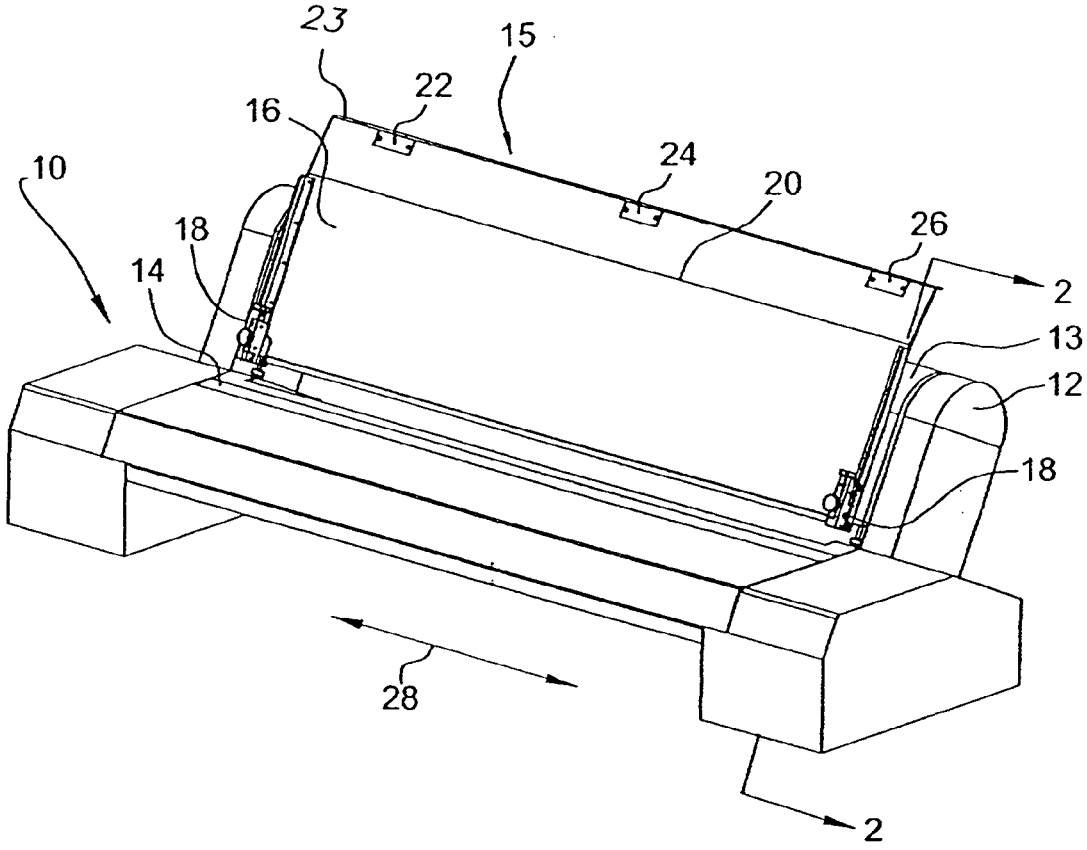
FIG. 1 is a perspective view of an alignment device attached to an inkjet printer.

An embodiment of the present invention is shown in FIG. 1. A wide format inkjet printer 10 has an upwardly projecting roll-feed media supply compartment 12. Roll feed media is dispensed directly into the printer from compartment 12. Compartment 12 has a cover portion 13 that opens upwards to allow access to change the media roll. Individual sheets of media may be fed to the printer via slot 14. An alignment device 15 is attached to the cover 13 of compartment 12 via a pair of adjustable brackets 18. The alignment device comprises a polycarbonate support surface 16 with registration plates 22, 24 and 26 secured to the upper edge. In the embodiment shown in FIG. 1, there is also a bend in the support surface at 20. The bend places the registration plates 22, 24 and 26 out of the plane of the support surface, although this feature is not mandated. Arrow 28 indicates the print axis, which in this case is parallel to the printhead traverse (printhead not shown).

Figure 2:
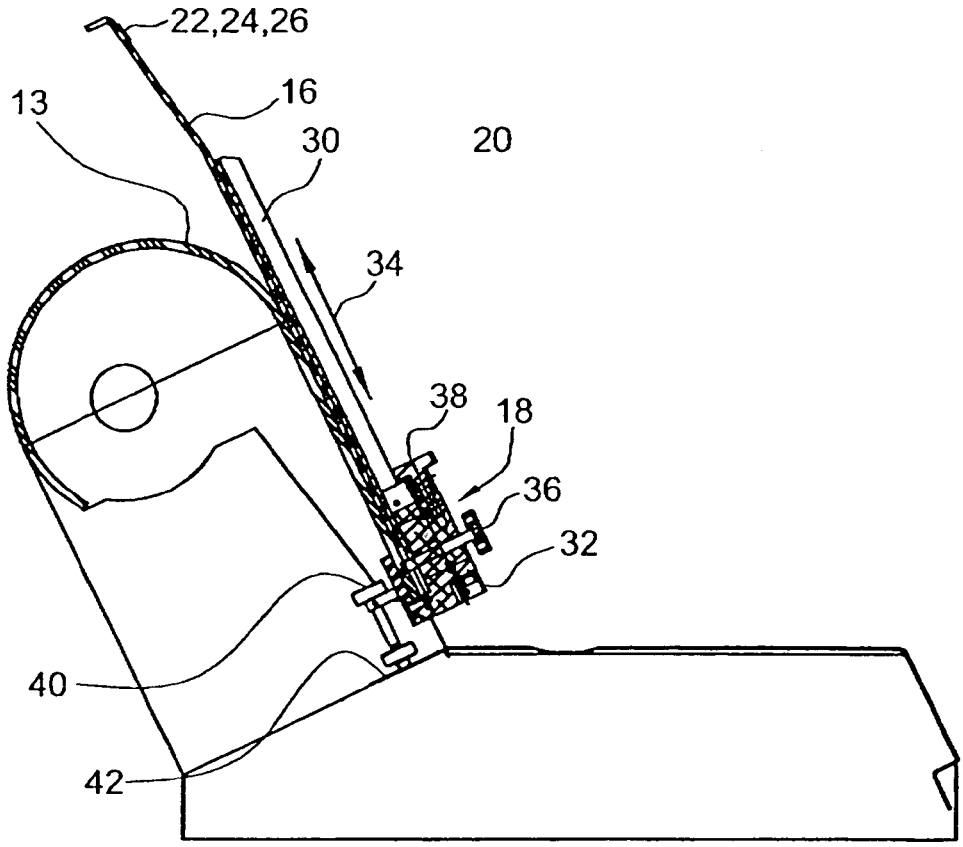
FIG. 2 is a sectional view of the printer taken along line 2—2 in FIG. 1.

Brackets 18 are shown in more detail in FIG. 2. Each bracket 18 has an elongate section 30 that is attached to the support surface 16 and a lower portion 32 that is U-shaped for engaging the lower edge of cover 13. Elongate section 30 and lower bracket portion 32 are moveable with respect to each other in the direction 34. The brackets 18 are secured to the cover via clamp screws 36 which, when tightened, grasp the lower edge of cover 13. The relative movement between bracket sections 30 and 32 is actuated by turning a thumb screw 38 thus providing adjustment of the skew of support surface 16 in displacing surface 16 relative to the cover 13.

Additionally, since the cover 13 is not particularly rigid the lower bracket portion 32 is equipped with an adjustment screw 40 that engages the body of printer 10 on surface 42, which is more rigidly connected to the printer frame. The adjustment provides a positive registration to the body of the printer without relying on the cover 13 alone to maintain the alignment.

Figure 3:
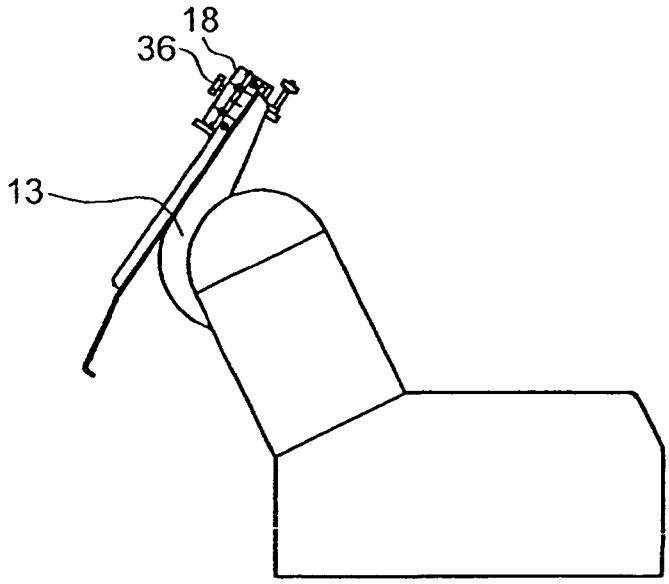
FIG. 3 is a side view of the printer shown in FIG. 1 with the roll-feed compartment cover open.

In operation the device must first be installed and then aligned to the printer. Once installed the device may be used without further adjustment unless the alignment is disturbed. The device is most conveniently installed with the roll cover 13 in an open or partially open position as shown in FIG. 3. The support surface 13 is attached to the lower edge of cover 13 via brackets 18 by tightening clamp screws 36. Once secured, the roll cover is closed (FIG. 2) and the adjustment screws 40 on each bracket 18 are adjusted until they just contact surface 42. Adjustment screws 40 are then given a further half turn to make a positive engagement with the printer body.

The skew of the support surface 16 is adjusted by first setting both alignment thumb screws 38 at a mid travel position and then loading a sheet of media (loading is described later). A test image having a horizontal line near the leading edge of the sheet is then printed. By definition the horizontal line is aligned with the print axis. The sheet is then unloaded and examined to determine the skew between the horizontal line and the leading edge of the sheet. Depending on the accuracy required the examination may be visual or may employ a measurement tool or jig to more accurately determine the misalignment. Any observed misalignment is converted into a corresponding adjustment of the alignment thumb screws 36 in accordance with a simple conversion factor. The operator then adjusts the screws as indicated and prints another test image, which either verifies alignment or indicates a further adjustment to be made. When the horizontal line is satisfactorily aligned with the edge of the sheet then the alignment device is also aligned to the print axis.

Figure 4:
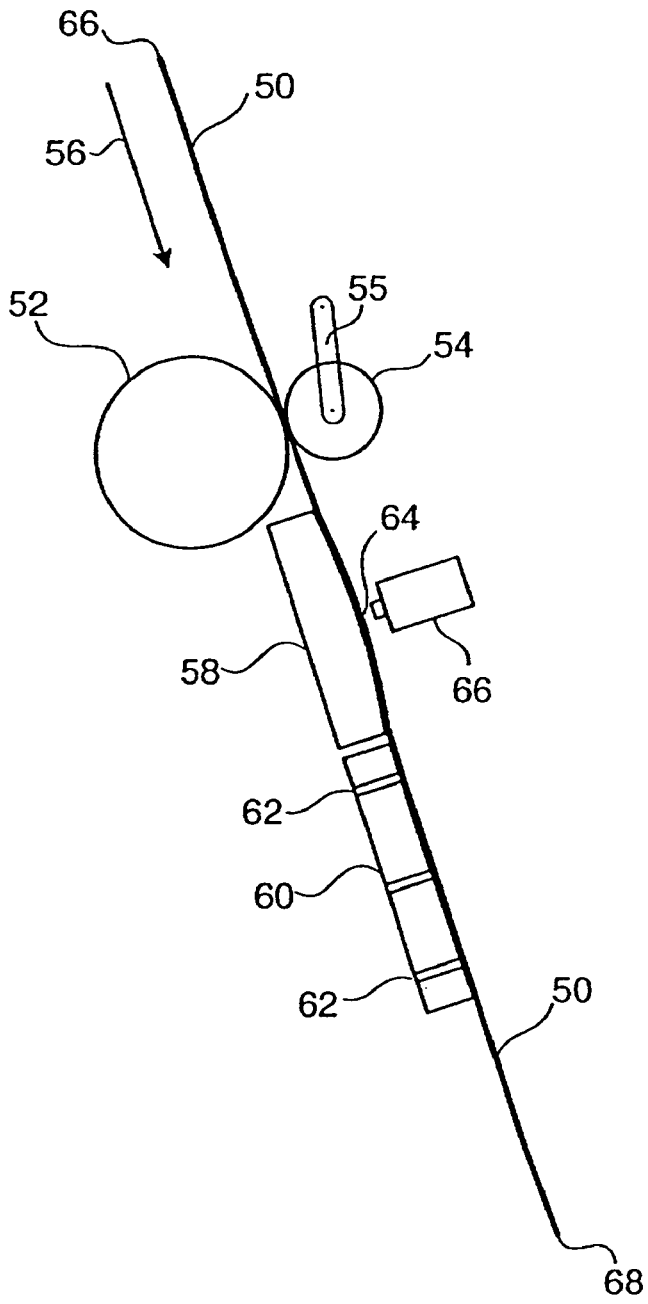
FIG. 4 is a schematic view of the feed path components of an inkjet printer.
Figure 6A:
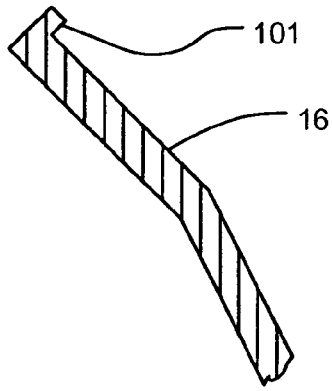
FIG. 6A shows a registration feature comprising a protruding lip.
Figure 6B:
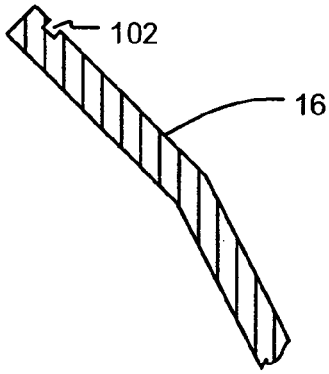
FIG. 6-B shows a registration feature comprising a groove.
Figure 6C:
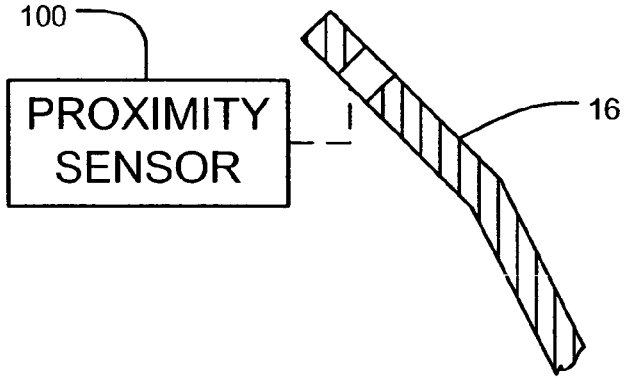

FIG. 4 schematically depicts the major components of the sheet feed mechanism for an Epson Stylus Pro 9600 printer. A media sheet 50 is pinched between a pair of rollers 52 and 54. Roller 52 is driven by a motor (not shown). Roller 54 is attached to linkage 55, which allows roller 54 to be pivoted in and out of contact with the media 50. With the roller 54 engaged, media 50 is advanced in the direction of arrow 56 over platen 58 and on to guide 60. Guide 60 has a plurality of ports 62 that are connected to a vacuum source (not shown). The vacuum prevents the media from flying up so that in the printing area 64, media 50 remains in intimate contact with the platen. The inkjet printheads 66 are disposed to print on media 50 as it passes through printing area 64 over platen 58. The applied vacuum is sufficient to stabilize the sheet while still allowing media advance in direction 56.

The loading operation, described in relation to FIGS. 1 and 4, involves first configuring the printer to accept sheet fed media by opening roller 54 and establishing a vacuum at ports 62. A media sheet 50 is grasped by the operator at the training edge 66, is placed against support surface 16 and then slid down until trailing edge 66 is below the registration plates 22, 24 and 26 and the leading edge 68 is engaged by the vacuum. The operator then pulls trailing edge 66 upwards and aligns it with at least two of the registration plates 22, 24 and 26. Under these conditions the sheet is aligned to the support surface, which has been previously aligned with the print axis. The operator can then release the media and press the load button, thus instructing the printer to close roller 54, which securely grasps the media. The printer is then ready to print the image after using the optical edge sensors to register the image to the sheet.

The bend 20 in the polycarbonate support sheet 16 allows the media to be placed on the support surface for loading without any obstruction by registration plates 22, 24 and 26. The media then rests on the support surface away from the registration plates and when aligning, the trailing edge is pressed down to contact the registration plate edges located on the bent section.

Advantageously the present invention provides a simple add-on device that is easily installed and removed from an un-modified printer. The device provides a simple but effective manual alignment of a media sheet, thus preventing image skew. The present invention is enabled in part through the realization that it is not essential to align only to the leading edge of the media as long as the media sheets are orthogonally cut. For proofing media, which must typically be qualified to ensure color accuracy, it is a simple matter to also qualify the sheet orthogonality. The sheet orthogonality, once established, allows registration to the trailing edge of the media without any significant loss of registration accuracy. Additionally, the present invention, in aligning to the trailing edge avoids the need to place a registration feature in the path of the media feed which must be removed during printing operations. Finally the alignment against the registration plates is located at a convenient height in front of the operator and there is no need for the operator to stoop down to view a registration feature further down in the feed path.

In an alternative embodiment shown in FIG. 5-A the alignment device 15 is attached to the roll cover 13 of a printer 10 via brackets 18 as in previously described embodiments. However, in this case a lock 72 is secured to printer frame 70. The lock, shown in more detail in FIG. 5-B, comprises a latch plate 74 that is securely attached to the printer frame 72. Latch plate 74 has a notch 76 for receiving a pin 78 on bracket 18 (FIG. 5-A) . A locking plate 80 is attached to the latch plate 74 via pivot 82. A spring (not shown) attached between ears 84 is used to bias the locking plate 80 and latch plate 74 into the position shown in FIG. 5-B. The locking plate has a protruding finger 86 that projects past the roll cover 13 to allow unlocking by the user.

In the closed position the pin 78 on bracket 18 engages the notch 76 of latch plate 74 and locking plate 80 positively retains pin 78 in notch 76. When the user wishes to open the roll cover, the protruding finger 86 is depressed, unlocking plate 80 and thus freeing pin 76. The roll cover 13 is then free to open with the alignment device 15 attached. When the roll cover is closed, pin 78 engages notch 76 and also depresses locking plate 80. When pin 78 is seated in notch 76 the locking plate 80, which is biased by a spring, closes positively retaining pin 78.

The lock makes it less likely that the alignment will be disturbed by the operator and also improves the repeatability of alignment after the roll cover 13 has been opened.

While the above embodiments have been described in reference to a specific hardware embodiment a person of skill in the art will readily appreciate that there are many alternatives are possible without departing from the scope of the invention. For example while a registration plate has been described the registration features may also be implemented using a proximity sensor for detecting the edge of the sheet and adapted to present feedback to the operator by visual or other means. The proximity sensor may be optical, a contact switch, or any other type known in the art. The registration feature may also be a simple line 23 marked on the support surface, a laser beam projecting across the support surface or a lip or groove formed in the support surface.

The brackets used to attach the device to the printer may likewise be varied or even omitted in favor of another means of attachment. While the embodiment described has a pair of adjustable brackets, it is only required that one of the brackets be adjustable, the other bracket being a simple pivot. It is preferable that the device be attached directly or indirectly to the printer frame to ensure best alignment accuracy and repeatability but where it is desired to provide an easy user installable upgrade this may not be possible.

While the alignment device has been described in terms of an add-on jig that can be attached to an existing printer this is not mandated. The device may be incorporated into the printer covers or the registration features can be directly applied to an existing cover such as the roll feed media cover or other existing loading table or ramp.

Furthermore, while the invention has been described in relation to a specific inkjet printer, it should be readily appreciated that the alignment technique may be applied to a variety of other inkjet printers as well as other non-inkjet based printers. Details such as the feed path or mounting features may vary from those illustrated in the described embodiment without departing from the scope of the invention.

As will be apparent to those skilled in the art in light of the foregoing disclosure, many alterations and modifications are possible in the practice of this invention without departing from the spirit or scope thereof.

What is claimed is:

1. An alignment device for aligning a media sheet with a print axis of a printer, the media sheet having a leading edge and a trailing edge, the device comprising at least one registration feature for aligning the trailing edge of the media sheet in a direction that is parallel to the print axis of the printer, and a mechanism for adjusting the alignment of the registration feature so that the direction is aligned with the print axis of the printer wherein the at least one registration feature comprises a line marked on the alignment device.

2. A method of aligning a media sheet to be loaded into a printer along a feed path, the sheet having a leading edge and a trailing edge, the method of comprising:

loading the media sheet so that the leading edge of the sheet is in proximity to the feed path;

adjusting an orientation of a registration feature that is stationary relative to the feed path so that the registration feature is in alignment with aprint axis of the printer;

aligning the trailing edge of the media sheet to the registration feature; and moving the media sheet along the feed path.

3. The method of claim 2, wherein the media sheet has a front printable surface and a rear printable surface and the method comprises aligning the trailing edge of the media sheet with the registration feature with the media sheet oriented for printing on the front printable surface and, on completion of the printing of the front printable surface, flipping the media sheet and aligning a trailing edge of the flipped media sheet with the registration feature, with the media sheet oriented for printing on the rear printable surface.

* * * * *